United States Patent [19]

Manser et al.

[11] 4,208,806

[45] Jun. 24, 1980

[54] PROCESS FOR TREATMENT OF POURABLE MATERIALS WITH MICROWAVES

[75] Inventors: Josef A. Manser, Uzwil; Georg Dankesreiter, Oberburen, both of Switzerland

[73] Assignee: Gebrueder Buehler AG, Uzwil, Switzerland

[21] Appl. No.: 955,456

[22] Filed: Oct. 27, 1978

Related U.S. Application Data

[63] Continuation-in-part of Ser. No. 710,343, Jul. 30, 1978, Pat. No. 4,126,945.

[51] Int. Cl.[2] ..... F26B 3/34

[52] U.S. Cl. ..... 34/1; 34/4

[58] Field of Search ..... 34/1, 4; 426/467

[56] References Cited

U.S. PATENT DOCUMENTS

| | | | |
|---|---|---|---|
| 3,063,848 | 11/1962 | Van Gelder | 426/467 |
| 3,528,179 | 9/1970 | Smith | 34/1 |
| 3,611,582 | 10/1971 | Hamid et al. | 34/1 |
| 3,977,089 | 8/1976 | Forster et al. | 34/1 |

*Primary Examiner*—John J. Camby

*Attorney, Agent, or Firm*—Merchant, Gould, Smith, Edell, Welter & Schmidt

[57] ABSTRACT

This invention relates to apparatus and method for microwave drying conducted at a higher microwave energization level while avoiding scorching of the material. The increasing energization includes the formation and interruption of chains of particles of the material in mutual contact and extending transverse to the flow of material and in line with the electric field of the energization.

21 Claims, 5 Drawing Figures

PROCESS FOR TREATMENT OF POURABLE MATERIALS WITH MICROWAVES

This application is a continuation-in-part of application Ser. No. 710,343, filed July 30, 1978, now U.S. Pat. No. 4,126,945.

TECHNICAL FIELD

The present invention relates to a process for treatment of bulk materials, in particular foodstuffs, with microwaves, as well as to a contrivance for carrying out the process with a microwave generator and an adjacent treatment space in which the material is subjected to the action of microwaves, with an inlet and an outlet for the material to be treated.

BACKGROUND

It is known how to feed a material to be treated, for drying, for killing off micro-organisms or for popping, on a conveyor belt or a fluidization bed in the longitudinal direction through a microwave waveguide and then heating the material to be treated. Particularly in the case of drying it has been shown that in the case of treatment of a pourable material local overheating with scorching can occur when working with higher microwave energy densities. Consequently, up to the present time, drying has had to be undertaken at low power of the microwave generator and, therefore, with lesser drying output (kilograms of dried product per unit of time).

The present invention takes upon itself the task of achieving an essentially greater output than was previously possible when treating bulk materials with the aid of microwaves.

SUMMARY OF THE INVENTION

In accordance with the invention, this task is accomplished in that contacting points between adjacent particles of the bulk material are being continuously established and shifted during energy conversion within the microwave field, at least in the direction of the electrical field, in particular for formation of shifting particle chains in the direction of the electrical field strength vector of the microwaves.

The invention brings about the advantage of being able to heat quickly, and without damage, difficult to treat materials such as pasta products. A further advantage consists in the fact that particles with a diameter smaller than 10 mm can be treated with good utilization of energy.

BRIEF DESCRIPTION OF THE DRAWINGS

The invention is explained, as an example, with the aid of the accompanying schematic drawing. Shown are.

DETAILED DESCRIPTION OF THE INVENTION

Figure 1:
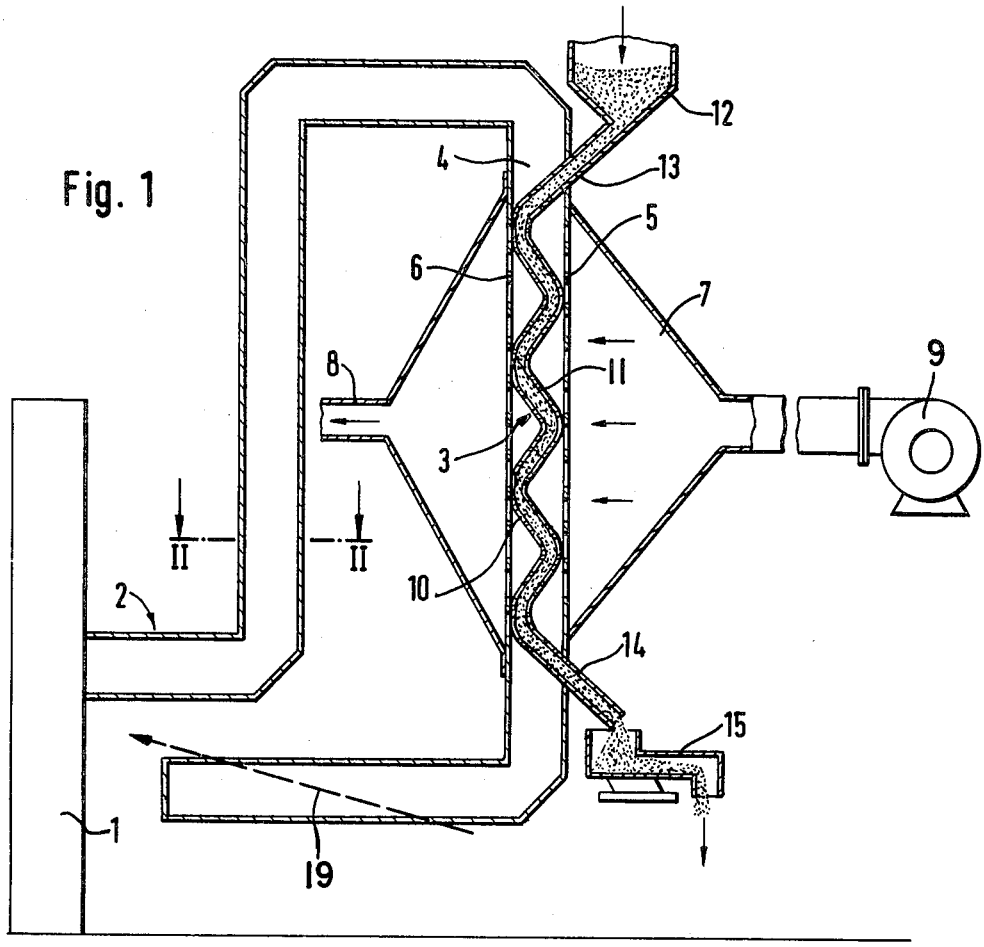
FIG. 1 is a side view of a first example of embodiment.
Figure 2:
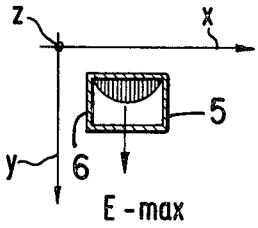
FIG. 2 a cross section through the waveguide along line 2—2 in FIG. 1.

The example of embodiment in accordance with FIGS. 1 and 2 displays a microwave generator 1 to which a waveguide 2 connects. The microwave generator 1 can, for example, be laid out for an electrical power of 25 Kw at a frequency of 915 MHz. The waveguide 2 displays a rectangular cross section whose dimensions are adapted to the operating frequency, and in the present case at 915 MHz are 150×250 mm. Reference numeral 4 designates a straight, vertical section of waveguide 2, which forms the actual treatment space. The section 4 of waveguide 2 consists of the same electrically conductive material and has the same cross section as the other parts of waveguide 2. In the waveguide section 4, the narrow walls 5 and 6 are perforated, i.e. air permeable. Because of the special behavior of microwaves inside a waveguide, radiation through the perforated walls 5 and 6 does not occur.

Terminating at the perforated wall 5 is a feed air line 7 connected to a source of air under pressure such as a blower 9, and a discharge air line 8 adjoins wall 6. The treatment air introduced through feed air line 7 cools the materials to be treated and can lead in or lead out moisture. Another treatment gas can be selected instead of air.

Arranged in waveguide section 4 is a cascade-form chute or duct 3 that runs zig-zag fashion at any given time, transversely to the electrical field strength vector. Chute 3 displays two perforated walls 11 and 10 made of a material with particularly low dielectrical losses, which connect laterally on the broad walls of waveguide 2 and form, with this latter, the rectangular cross section hollow profile of the cascade-form chute. At the start, the material to be treated is loaded into a hopper 12, from whence it passes, through an inlet 13, into the cascade-form chute 3, which it leaves through an outlet 14. Both the inlet 13 and the outlet 14 are constructed as UHF locks. The microwaves not absorbed by the materials being treated are absorbed, in known manner, in a water load 19.

Associated with outlet 14 is a vibrator 15. The quantity of treated material flowing from inlet 13 to outlet 14 can be regulated with vibrator 15. The material to be treated, in addition to moving in the longitudinal direction of the waveguide 2 (z-axis), is moved to and fro transversely to the electrical field strength vector (y-axis) through the cascade-form, i.e. the cascade-form deflection imparts to the material being treated a continuous motion toward another direction in space (x-axis). With flowthrough of the material being treated, there further occurs a displacement of the individual particles in the direction of the y-axis as well as rotation about one or more of the three space axes. This persistent relative motion between the individual particles of the material in chute 3 is additionally sustained by the air blown through from feed air line 7. This feed air can be assigned the task, through its convection action, of promoting uniform heating of the individual particles. Consequently, working with cool air is not absolutely necessary.

Further, it is possible to transmit the microwaves through the waveguide in the direction opposite to that of conveying the material to be treated. In this case, with the contrivance in accordance with FIG. 1, the microwave generator 1 and the water load 11 must be mutually reversed.

FIG. 2 shows the pattern of electrical field strength. Its vector Y is parallel to the narrow sides 5 and 6 of waveguide 2 and oriented perpendicularly to the centers of the two broad sides. Through means of the cascade-form structure of chute 3, the material to be treated is guided from a field strength minimum through the maximum to the other minimum and back. The individual particles of the material are, in this manner, repeatedly guided through the zone of the electrical field strength maximum. A uniform transfer of energy is achieved in this fashion.

Figure 3:
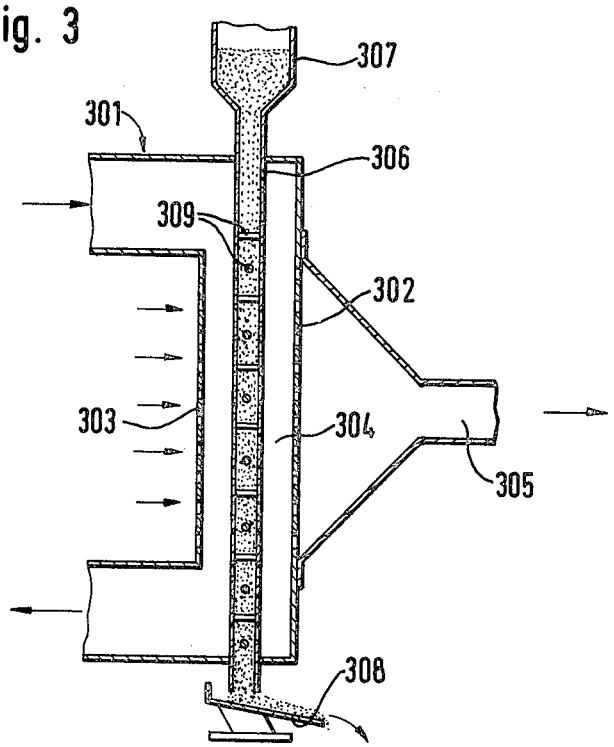
FIG. 3 a side view of a second example of embodiment.

FIG. 3 shows an example of embodiment in which a waveguide 301 displays a vertical section 304 of rectangular cross section, with perforated narrow sides 302 and 303. Air under pressure is blown into waveguide 301 through one of these narrow sides 303 and is led off through the other narrow side 302. Connecting to narrow side 302 is a discharge air line 305. Associated with the waveguide 301 is a microwave generator and a water load that are not illustrated.

Arranged axially within waveguide section 304 is a chute 306 in the form of a rectangular tube made of material with especially low dielectric losses. Chute 306 displays perforated walls. The material to be treated arrives in the chute 306 through a feed hopper 307. At the outside of waveguide 301, there is associated to chute 306 a vibrator 308 through means of which the flowthrough velocity of the material to be treated through the chute 306 can be regulated. Inside cute 306 movement between the individual particles is forced in the direction of one space axis (z-axis). Advantageously, transversely oriented rods 309, made of electrically non-conducting material, can be arranged in the chute 306, which force changes in direction upon the material to be treated toward at least one of the two other space axes (x- and y-axes). Such types of rods 309, or similarly acting components, are however, not necessary, depending upon the material treated. Chute 306 can also pass diagonally or in a curve through waveguide section 302, so that the material to be treated is moved from a minimum of the electrical field strength through the maximum, to the other minimum. Such a measure can be especially useful when components 309 are omitted and a displacement of the material to be treated in the area of the microwaves is to be produced along at least two space axes.

Figure 4:
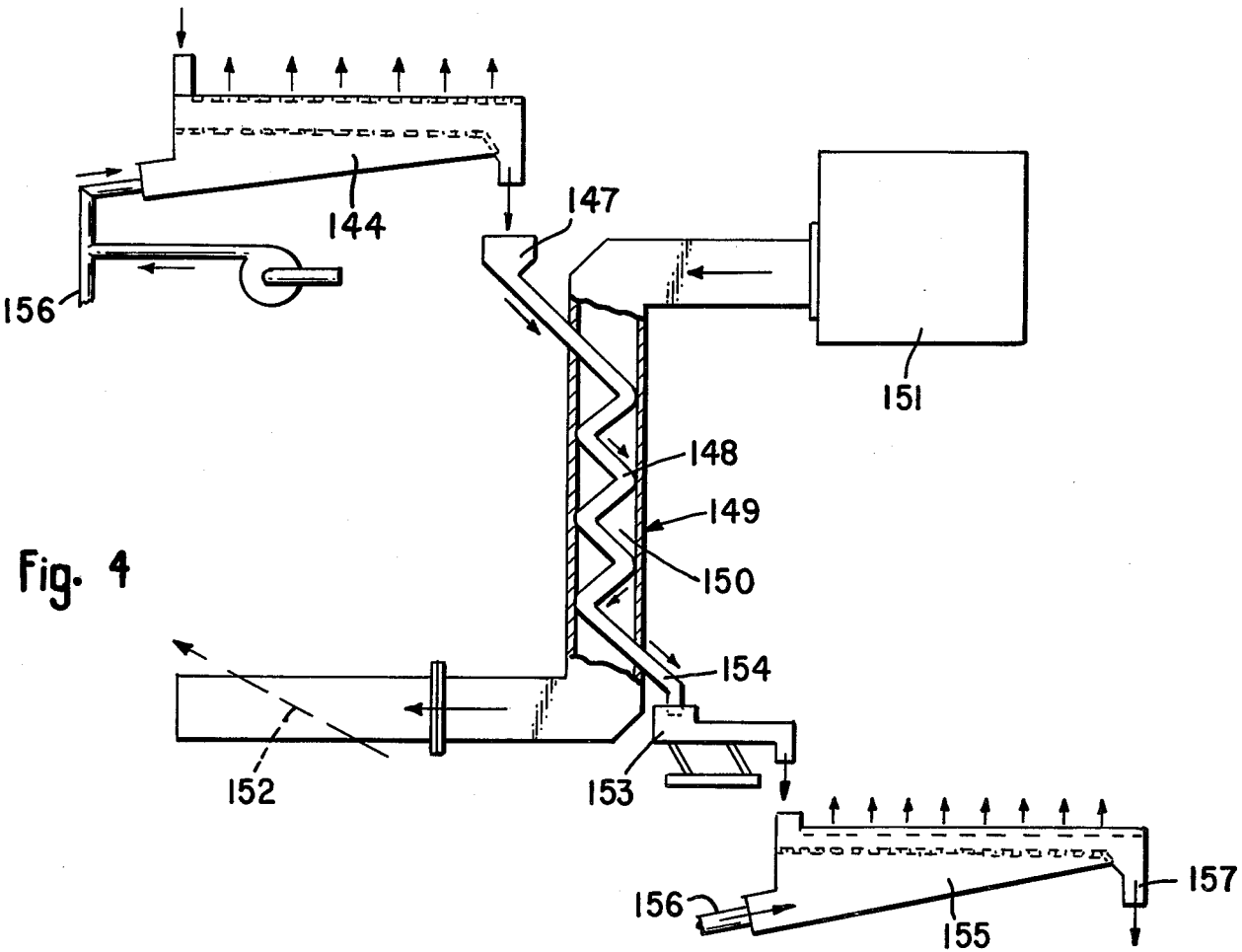
FIG. 4 a side view of a further example of embodiment.

It is also possible however, to not provide any perforated walls in section 302 of waveguide 301 as well as chute 306, and instead to provide a turbulence bed device for affording a gas treatment to the material to be treated after it leaves the waveguide. An embodiment of this invention having these characteristics is shown in FIG. 4. A waveguide 143 has a vertical section 150 of rectangular cross section connected between a microwave generator 151 and a water load 152. Arranged in waveguide section 150 is a cascade-form chute 148 made of low-line material like chute 3 of FIG. 1, but without perforations. Material is fed to chute 148 by a hopper 147 and is discharged at an outlet 154 associated with a vibrator 153 to regulate the flow of material through the chute. Material discharged from vibrator 153 is fed to a separate gas treatment unit 155 shown as a turbulence bed supplied with air under pressure through a conduit 156, treated material being discharged at 157. If desired, the material supplied to hopper 147, may be provided by yet another gas treatment unit 144.

Figure 5:
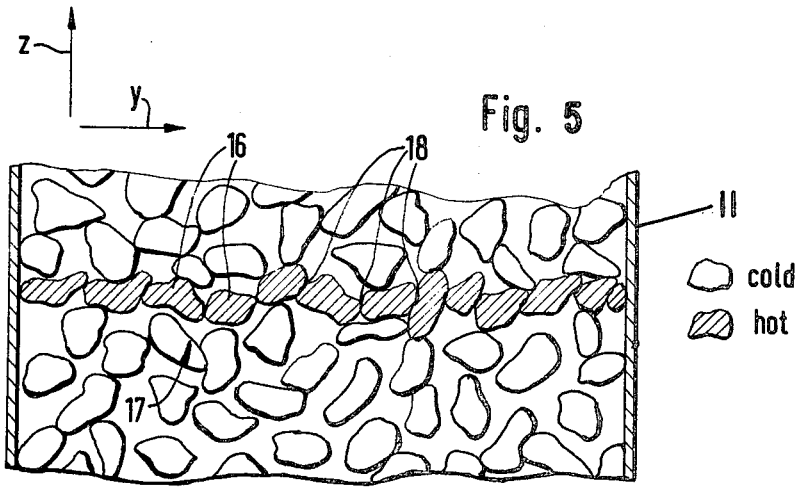
FIG. 5 a schematic illustration of the position of the particles in a chute.

FIG. 5 shows schematically the relative positions of the individual particles as they move in the cascade or tube-form chute 3 and/or 306. The individual particles 16 are in mutual contacting engagement. Tests have shown that, in this case, only those particles are heated whose mutual points of contacting engagement 18 lie at least approximately in the y-axis, i.e. in the direction of the electrical field strength vector E. Heating of the individual particles is accomplished only when the particle chains 17 forming in the y-direction display a length of at least 10 mm. The flow of energy in the direction of such a chain must, however, not last too long, since otherwise scorching occurs on the particles in the area of the points of contact 18. In order to guarantee optimum utilization of the microwave energy, i.e. in order to achieve fast heating of the individual particles 16 without scorching at the points of contact 18, various chains 17 must be formed in chute 3, 148, or 306, broken up and formed again anew with other particles. From this result the requirement that the individual particles 16, at least in the direction (y-axis) of the electrical field E, must be in mutual contacting engagement, and that the points of contact 18 must be continually changed and/or the particles adjacent to each other exchanged.

What is claimed is:

1. A process for the treatment, with microwave energy, of particulate material moving through the energy in a direction having a principal vertical component with which the direction of propagation of the energy is aligned, said process comprising the step of regulating the rate of movement of the material so as to promote the formation and interruption of chains of contacting particles of said material having substantially the direction of the electric field of said energy.

2. A process according to claim 1 including the further step of imparting to the direction of movement of the material a further component transverse to said primary component.

3. A process according to claim 2 in which said further step comprises causing said material to move back and forth zig-zag fashion transversely of said electric field.

4. A process according to claim 1 in which said principal component is opposite to said direction of propagation.

5. A process according to claim 1 in which said principal component is the same as said direction of propagation.

6. A process according to claim 1 in which said chains are at least 10 millimeters in length.

7. A process according to claim 1 including the further step of blowing gas through the material while it is in the microwave energy.

8. A process for the treatment, with microwave energy, of particulate material moving through the energy in a direction having a principal vertical component with which the direction of propagation of the energy is aligned, said process comprising the step of imparting to the direction of movement of the material a further component transverse to said primary component and to the direction of the electric field of said energy.

9. Apparatus for treating particulate material with microwave energy comprising, in combination:

means propogating, in a vertical direction, microwave energy having an electric field orthogonal to said predetermined direction;

means transparent to microwave energy for causing movement of said material through said energy in a direction having a primary component aligned with said predetermined direction; and means for promoting the formation and interruption of chains of contacting particles of said material extending in the direction of said electric field.

10. Apparatus according to claim 9 in which the last named means comprises means for regulating the rate of said movement of said material.

11. Apparatus according to claim 9 in which the last named means comprises means for imparting to said movement of said material a reversing component transverse to said primary component.

12. Apparatus according to claim 11 in which said reversing component is transverse to the direction of said field.

13. Apparatus according to claim 9 in which the first named means includes a microwave generator and a wave guide connected thereto for energization therefrom, and in which the second named means comprises a chute of material transparent to microwave energy, arranged within the wave guide between an inlet and an outlet for said material.

14. Apparatus according to claim 13 in which said wave guide extends generally vertically and said chute extends generally vertically therein.

15. Apparatus according to claim 13 in which said wave guide extends generally vertically and said chute is structured cascade-form within said wave guide.

16. Apparatus according to claim 13 in which said wave guide extends generally vertically and said chute comprises a square duct axially within said wave guide.

17. Apparatus according to claim 15 in which said chute includes a plurality of members of material transparent to microwave energy, spaced therealong for causing deflection of said particles from the direction of said primary component.

18. Apparatus according to claim 13 in which microwave generator is connected to said wave guide near the outlet for said material.

19. Apparatus according to claim 13 in which said microwave generator is connected to said wave guide near the inlet for said material.

20. Apparatus according to claim 13 in which said chute has a dimension of at least 10 millimeters in the direction of said electric field.

21. Apparatus according to claim 13 in which said wave guide and said chute are constructed to enable flow of gas therethrough transverse to said principal direction.

* * * * *